US010280814B2

(12) United States Patent
Noguchi et al.

(10) Patent No.: US 10,280,814 B2
(45) Date of Patent: May 7, 2019

(54) VALVE OPENING/CLOSING TIMING CONTROL APPARATUS

(71) Applicant: AISIN SEIKI KABUSHIKI KAISHA, Kariya-shi, Aichi (JP)

(72) Inventors: Yuji Noguchi, Obu (JP); Takeo Asahi, Kariya (JP); Hiroyuki Hamasaki, Obu (JP); Toru Sakakibara, Anjo (JP); Tomohiro Kajita, Chiryu (JP); Hideyuki Suganuma, Anjo (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 85 days.

(21) Appl. No.: 15/319,082

(22) PCT Filed: Oct. 28, 2015

(86) PCT No.: PCT/JP2015/080361
§ 371 (c)(1),
(2) Date: Dec. 15, 2016

(87) PCT Pub. No.: WO2016/068179
PCT Pub. Date: May 6, 2016

(65) Prior Publication Data

US 2017/0145872 A1 May 25, 2017

(30) Foreign Application Priority Data

Oct. 31, 2014 (JP) ..... 2014-223318

(51) Int. Cl.
*F01L 1/34* (2006.01)
*F01L 1/047* (2006.01)
*F01L 1/344* (2006.01)

(52) U.S. Cl.
CPC ..... *F01L 1/3442* (2013.01); *F01L 1/047* (2013.01); *F01L 2001/0476* (2013.01);
(Continued)

(58) Field of Classification Search
CPC ..... F01L 1/3442; F01L 1/344; F01L 2001/34483
(Continued)

(56) References Cited

U.S. PATENT DOCUMENTS 6,276,321 B1 * 8/2001 Lichti ..... F01L 1/3442 123/90.17
2009/0069097 A1 * 3/2009 Fischer ..... F01L 1/3442 464/1
(Continued)

FOREIGN PATENT DOCUMENTS

JP 2007-278306 A 10/2007
JP 2009-062978 A 3/2009
(Continued)

OTHER PUBLICATIONS

Fnglish language translation of International Preliminary Report on Patentability (Forms PCT/IB/338, PCT/IB/373 and PCT/ISA/237), with Written Opinion, dated May 11, 2017, by the International Bureau of WIPO in corresponding International Application No. PCT/JP2015/080361. (8 pages).
(Continued)

*Primary Examiner* — Mark A Laurenzi
*Assistant Examiner* — Wesley G Harris
(74) *Attorney, Agent, or Firm* — Buchanan Ingersoll & Rooney PC

(57) ABSTRACT

A spring holder supporting a torsion spring applying an urging force in a valve opening/closing timing control apparatus is configured to be able to be attached to an appropriate position relative to a driven side rotary body and rotatable in unison. The spring holder includes a seat portion that is connected and fixed to the driven side rotary body, a guide portion that extends along a rotational axis, an alignment portion fitted into an engaging portion of the driven side rotary body and a restricted portion fitted into a restrict-
(Continued)

ing portion of the driven side rotary body. A support portion holding an end of the torsion spring is formed in the guide portion.

6 Claims, 7 Drawing Sheets

(52) U.S. Cl.
CPC ..... *F01L 2001/34433* (2013.01); *F01L 2001/34469* (2013.01); *F01L 2001/34479* (2013.01); *F01L 2001/34483* (2013.01); *F01L 2103/00* (2013.01); *F01L 2250/02* (2013.01); *F01L 2250/04* (2013.01); *F01L 2810/03* (2013.01); *F01L 2820/031* (2013.01)

(58) Field of Classification Search
USPC ..... 123/90.15, 90.17
See application file for complete search history.

(56) References Cited

U.S. PATENT DOCUMENTS

2009/0235884 A1 9/2009 Fischer et al.
2013/0167787 A1* 7/2013 Noguchi ..... F01L 1/3442 123/90.17
2013/0233263 A1* 9/2013 Kinouchi ..... F01L 1/3442 123/90.17
2015/0096513 A1 4/2015 Noguchi et al.

FOREIGN PATENT DOCUMENTS

JP 2012-092739 A 5/2012
JP 2013-185459 A 9/2013

OTHER PUBLICATIONS

International Search Report (PCT/ISA/210) dated Dec. 28, 2015, by the Japanese Patent Office as the International Searching Authority for International Application No. PCT/JP2015/080361.
n
Written Opinion (PCT/ISA/237) dated Dec. 28, 2015, by the Japanese Patent Office as the International Searching Authority for International Application No. PCT/JP2015/080361.

* cited by examiner

VALVE OPENING/CLOSING TIMING CONTROL APPARATUS

TECHNICAL FIELD

The present invention relates to a valve opening/closing timing control apparatus that externally includes a torsion spring for displacing a rotational phase between a driving side rotary body and a driven side rotary body in a predetermined direction by an urging force.

BACKGROUND ART

As an example of a valve opening/closing timing control apparatus ("a valve timing adjusting mechanism" in the document), PTL 1 discloses a technique having a torsion spring ("a coil spring" in the document) for urging a driven side rotary body ("a vane rotor" in the document) relative to a driving side rotary body ("a housing" in the document) in an advancing direction.

In this PTL 1, a bottomed cylindrical bush exposed on a front face side of the driving side rotary body is connected to a cam shaft, and this bush includes a torsion spring. One end side of the torsion spring is engaged with the driving side rotary body and the other end thereof is engaged with the driven side rotary body. In this configuration, as the torsion spring is placed in abutment against a plurality of portions of the bush, the torsion spring is corrected so that a center axis of this torsion spring may be parallel with the rotational axis.

Further, PTL 2 discloses a technique including a driving side rotary body ("a housing" in the document) and a driven side rotary body ("a vane member" in the document) and the driven side rotary body includes a support member which supports a torsion spring.

In this PTL 2, the support member includes a restricting portion for restricting collapse of the torsion spring, the restricting portion being disposed on an outer side of a front plate provided on a front face side of the driving side rotary body, and the torsion spring is disposed between the restricting portion and the front plate, and one end of this torsion spring is supported to the front plate and the other end thereof is supported to the restricting portion of the support member.

CITATION LIST

Patent Literature

PTL 1: Japanese Unexamined Patent Application Publication No. 2013-185459

PTL 2: Japanese Unexamined Patent Application Publication No. 2007-278306

SUMMARY

Technical Problem

As an arrangement for supporting one end of a torsion spring to a driving side rotary body, it is conceivable to insert the end in a hole portion formed under a posture parallel with a rotational axis relative to the driving side rotary body. With this arrangement, insertion of one end of the torsion spring into the hole portion was troublesome, which made assembly of the valve opening/closing timing control apparatus difficult. Further, the support member disclosed in PTL 2 tends to invite enlargement.

Then, there is a need for obtaining an arrangement that readily supports a torsion spring for providing an urging force in a valve opening/closing timing control apparatus having a spring holder. Further, there is also a need for obtaining an arrangement that supports the spring holder under a stable posture in a reliable manner.

Solution to Problem

According to a characterizing feature of the present invention, a valve opening/closing timing control apparatus comprises:

a driving side rotary body rotatable in synchronism with a crank shaft of an internal combustion engine;

a driven side rotary body rotatable in unison and coaxially with a valve opening/closing cam shaft; and a spring holder supporting a torsion spring that is connected between the driving side rotary body and the driven side rotary body;

wherein the spring holder includes a seat portion that is fixed to an engaging portion provided in the driven side rotary body by being fitted therein, and a guide portion that protrudes from the seat portion along a rotational axis of the cam shaft;

wherein the seat portion defines an alignment portion engageable with the engaging portion effecting alignment and a restricted portion engageable with a restricting portion formed in the engaging portion in a radial direction perpendicular to the rotational axis, thereby to restrict rotation of the seat portion; and wherein the guide portion defines a support portion supporting an end of the torsion spring.

With the above configuration, as the seat portion is engaged with the engaging portion of the driven side rotary body and the alignment portion is engaged with the engaging portion of the driven side rotary body, a center position of the seat portion can be disposed on the rotational axis of the valve opening/closing timing control apparatus. Further, as the restricted portion is engaged with the restricting portion of the driven side rotary body, the driven side rotary body and the spring holder become rotatable in unison with each other.

Moreover, with the arrangement that the other end of the torsion spring is supported to the driving side rotary body with one end of the spring holder being supported to a support portion of the guide portion, supporting of the other end of the torsion spring can be carried out easily and also the urging force of the torsion spring can be applied between the driving side rotary body and the driven side rotary body.

In particular, since the torsion spring is disposed externally of the valve opening/closing timing control apparatus, even when friction powder debris is generated due to contact with the torsion spring, this debris will not enter the inside of the apparatus. Further, the arrangement makes it possible to form the valve opening/closing timing control apparatus compact in the rotational axis direction. Moreover, since the spring holder is supported with its seat portion being placed in contact with the driven side rotary body, the posture of the spring holder can be made stable. Therefore, there has been obtained an arrangement that readily supports a torsion spring for providing an urging force in a valve opening/closing timing control apparatus having a spring holder.

According to a possible alternative arrangement:

in the spring holder, the seat portion, a plurality of the guide portions and a plurality of the alignment portions are formed integral by a work on a plate-like material;

the guide portions and the alignment portions are disposed in alternation in a circumferential direction in an outer circumference of the seat portion; and at a mid positon therebetween, a portion of the seat portion is cut away in the direction of the rotational axis to form a cut-in portion.

With the above-described arrangement, by effecting a press work on a steel material for instance, the seat portion, the plurality of guide portions and the plurality of alignment portions can be formed integrally. Further, as the plurality of guide portions extend in the direction perpendicular to the seat portion, with forming of the cut-in portion, it is possible to prevent generation of distortion in the seat portion or the alignment portions at the time of press work.

According to a possible alternative arrangement, the support portion is formed by cutting away a portion of the guide portions into a form of a recess which cuts open a space supporting an end of the torsion spring.

With the above arrangement, by cutting away a portion of the guide portions, there is formed a recess as a cut-open space as the support portion. So, one end of the torsion spring can be supported by a simple arrangement.

According to a possible alternative arrangement:

relative to the seat portion, the plurality of guide portions are formed integral to extend along the rotational axis; and in an end face of the plurality of guide portions where the support portion is formed, there is formed a tilted portion that guides the end of the torsion spring to the support portion.

With the above-described arrangement, in case the torsion spring is supported by the guide portions and one end of the torsion spring is engaged with the support portion of the guide portion, one end of the torsion spring is placed in contact with the tilted face of the spring support portion, whereby this end will move along the tilted face to be engaged with the support portion. Thus, an attaching step of the torsion spring will be made simple.

According to a still possible alternative arrangement:

the driving side rotary body includes a lid body defining a through hole at the center thereof;

an outer circumferential diameter interconnecting outer circumferences of the plurality of guide portions centering about the rotational axis is set smaller than an inner diameter of the through hole; and an outer end diameter interconnecting outer ends of the alignment portions centering about the rotational axis is set greater than the inner diameter of the through hole.

With the above-described arrangement, when the spring holder is to be attached, the seat portion of the spring holder will be engaged with the engaging portion of the driven side rotary body and fixed in position by the alignment portions, and rotation restriction will be effected by the restricted portion. Next, the guide portions will be inserted into the through hole of the lid body and then the lid body will be connected to the driving side rotary body, whereby the alignment portions will be pressed down by the lid body, thus making it possible to prevent floating-up of the spring holder.

According to a still further alternative arrangement:

the torsion spring is disposed in an outer circumference of the plurality of guide portions; and the guide portion includes, at its end, an extension portion extending in the radial direction.

With the above-described arrangement, when the torsion spring is moved to the end portions of the guide portions, this torsion spring comes into contact with the extension portions, so that detachment thereof is prevented.

According to a further characterizing feature, a valve opening/closing timing control apparatus comprises:

a driving side rotary body rotatable in synchronism with a crank shaft of an internal combustion engine;

a driven side rotary body rotatable in unison and coaxially with a valve opening/closing cam shaft; and a spring holder supporting a torsion spring that is connected between the driving side rotary body and the driven side rotary body;

wherein the spring holder includes a seat portion that is fixed to an engaging portion provided in the driven side rotary body by being fitted therein, an alignment portion that protrudes outward from the seat portion under a posture perpendicular to the rotational axis, and a guide portion that protrudes from the seat portion along the rotational axis;

wherein the driving side rotary body includes a lid body that defines a through hole at a center thereof;

wherein an outer circumferential diameter of an outer circumference interconnecting a plurality of the guide portions centering about the rotational axis is set smaller than an inner diameter of the through hole; and wherein an outer end diameter interconnecting an outer end of the alignment portion centering about the rotational axis is set greater than the inner diameter of the through hole.

In the case of a conventional valve opening/closing timing control apparatus including externally a torsion spring, it is required to provide such an arrangement as e.g. a holder for supporting the torsion spring. Further, in the case of the arrangement wherein the holder is provided externally of the apparatus, it is also desired for the holder to be supported in a stable manner.

In addressing to such object as above, by fitting the seat portion into the engaging portion of the driven side rotary body, as provided in the above-described arrangement, it becomes possible to place the alignment portion in contact with the inner circumference of the engaging portion and to dispose the center position of the seat portion on the rotational axis of the valve opening/closing timing control apparatus. Further, when the spring holder is to be attached, the seat portion of the spring holder is fitted into the engaging portion of the driven side rotary body and then, the guide portion is inserted into the through hole of the lid body, thus connecting the lid body to the driving side rotary body. As a result, the alignment portion is pressed down by the lid body, whereby floating-up or detachment of the spring holder is prevented. Therefore, there has been obtained an arrangement that allows reliable support of the spring holder under a stable posture.

DESCRIPTION OF EMBODIMENTS

Next, an embodiment of the present invention will be explained with reference to the accompanying drawings.

Basic Configuration

Figure 1:
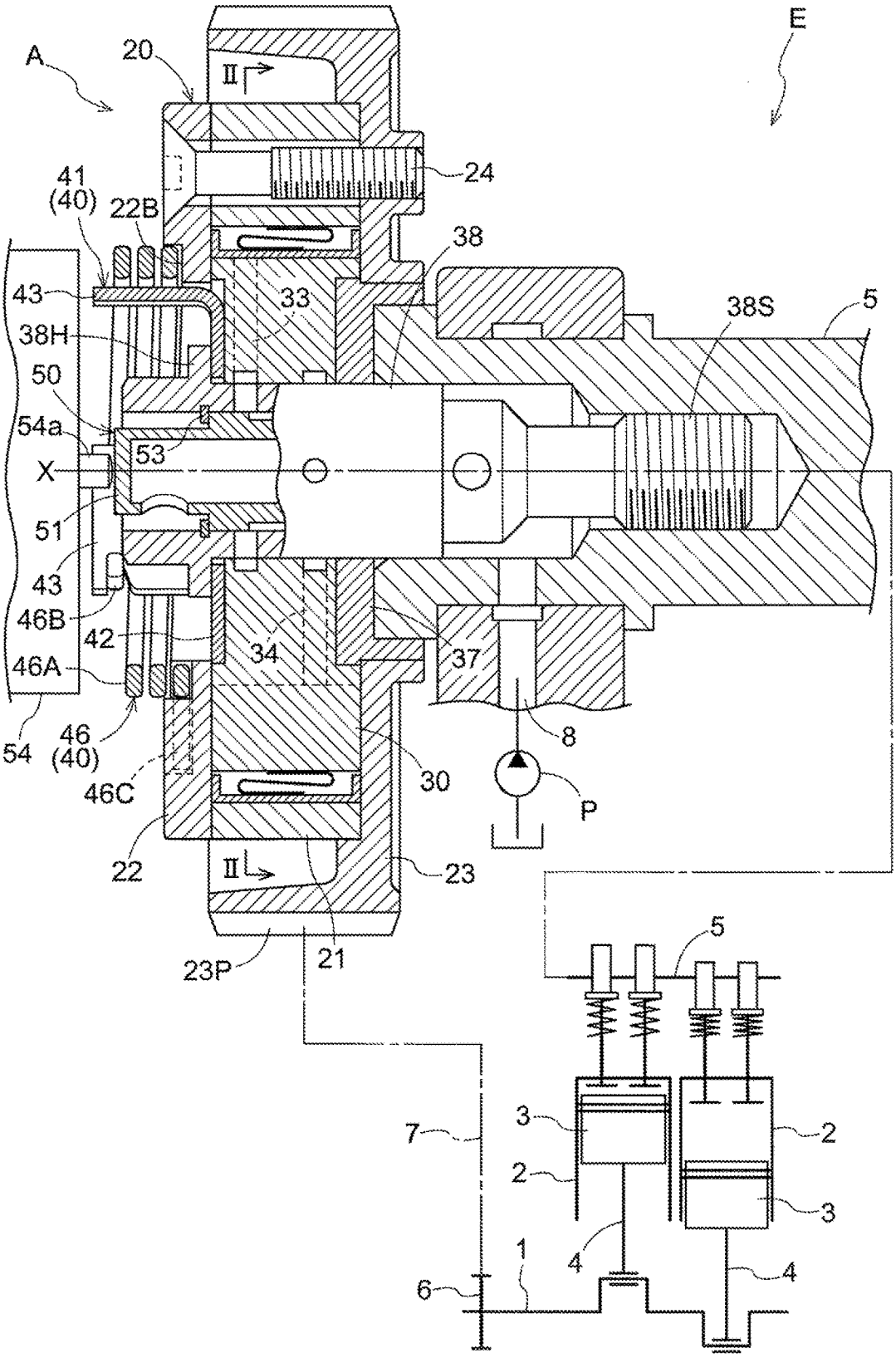
FIG. 1 is a section view of a valve opening/closing timing control apparatus.
Figure 2:
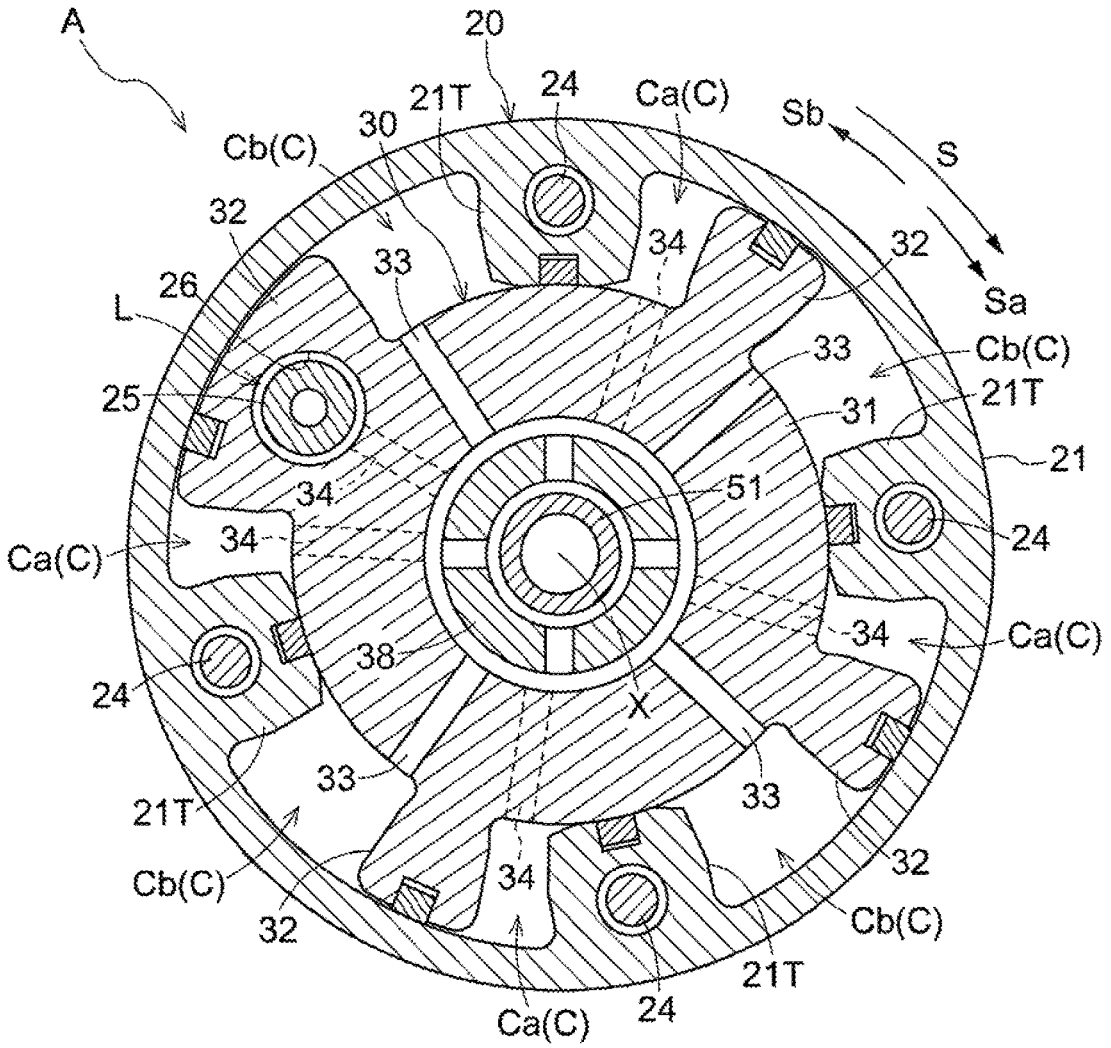
FIG. 2 is a section view taken along a line II-II in FIG. 1.
Figure 3:
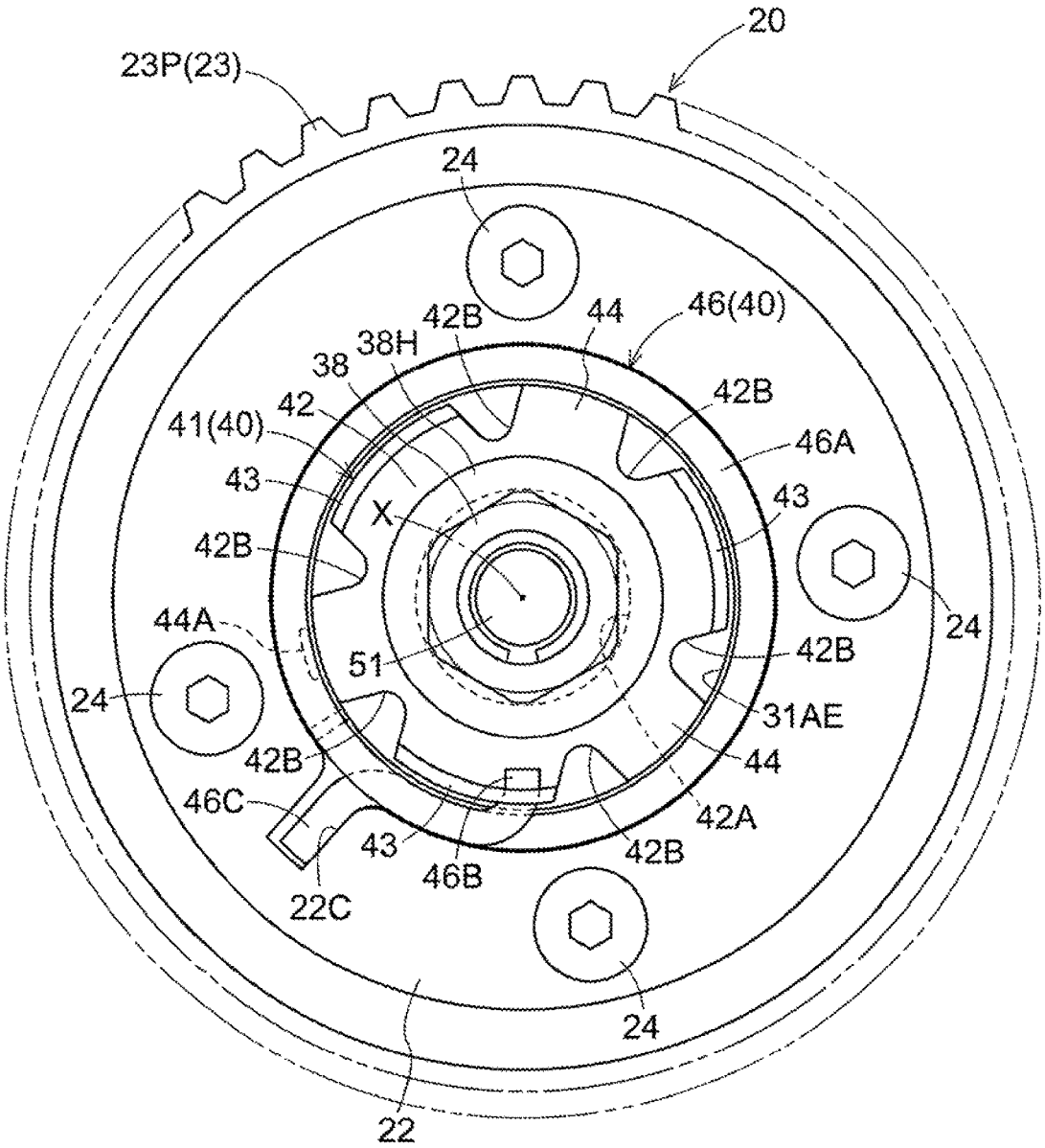
FIG. 3 is a view showing position relation between an urging unit and a front plate.

As shown in FIG. 1 and FIG. 2, a valve opening/closing timing control apparatus A includes an outer rotor 20 as a "driving side rotary body", an inner rotor 30 as a "driven side rotary body", an urging unit 40 as an "urging mechanism" for urging a relative rotational phase between the outer rotor 20 and the inner rotor 30 in an advancing direction, and an electromagnetic control valve 50.

The outer rotor 20 (an example of "driving side rotary body") is operably coupled to a crank shaft 1 of an engine E as an internal combustion engine via a timing belt 7 to be rotatable therewith in synchronism and disposed coaxially with a rotational axis X of an intake cam shaft 5. The inner rotor 30 (an example of "driven side rotary body") is disposed coaxially with the rotational axis X, thus being encased within the outer rotor 20 and connected to the intake cam shaft 5 to be rotatable therewith.

This valve opening/closing timing control apparatus A includes the electromagnetic control valve 50 coaxially with the rotational axis X of the inner rotor 30. The valve opening/closing timing control apparatus A changes a relative rotational phase between the outer rotor 20 and the inner rotor 30 by controlling work oil (an example of "fluid") by the electromagnetic control valve 50, thereby to control opening/closing timing of an intake valve 5V. Incidentally, the outer rotor 20 and the inner rotor 30 together function as a "phase control mechanism".

The engine E (an example of "internal combustion engine") is to be included in a vehicle such as a passenger car. This engine E includes the crank shaft 1 at a lower portion thereof, and a piston 3 is accommodated in a cylinder bore formed in a cylinder block 2 provided at an upper portion of the engine E. The engine E is configured as a 4 cycle engine with the piston 3 and the crank shaft 1 being connected via a connecting rod 4.

Incidentally, a transmission mechanism for transmitting rotational force of the crank shaft 1 to the valve opening/closing timing control apparatus A may employ a timing chain or may be configured such that the driving force of the crank shaft 1 is transmitted via a gear train having many gears.

Further, at an upper portion of the engine E, there are provided the intake cam shaft 5 and an exhaust cam shaft and also a hydraulic pump P driven by the driving force of the crank shaft 1 is provided. The intake cam shaft 5, as being rotated, opens/closes the intake valve 5V. The hydraulic pump P functions to feed lubricant oil reserved in an oil pan of the engine E as the work oil (an example of "fluid") via a feed passage 8 to the electromagnetic control valve 50.

As the timing belt 7 is routed around an output pulley 6 formed on the crank shaft 1 of the engine E and a timing pulley 23P, the outer rotor 20 is rotated in synchronism with the crank shaft 1. Though not shown in the drawings, a timing pulley is provided also at a front end of the exhaust side cam shaft and the timing belt 7 is routed around this timing pulley also.

Incidentally, in the instant embodiment, the valve opening/closing timing control apparatus A is provided in the intake cam shaft 5. Alternatively, the valve opening/closing timing control apparatus A may be provided in the exhaust cam shaft or may be provided in both the intake cam shaft 5 and the exhaust cam shaft.

As shown in FIG. 2, the valve opening/closing timing control apparatus A is configured such that the outer rotor 20 is rotated in a driving rotational direction S by the driving force from the crank shaft 1. Further, the direction of relative rotation of the inner rotor 30 relative to the outer rotor 20 in the same direction as the driving rotational direction S will be referred to as an "advancing direction Sa" and its opposite direction will be referred to as a "retarding direction Sb", respectively.

Valve Opening/Closing Timing Control Apparatus

Figure 5:
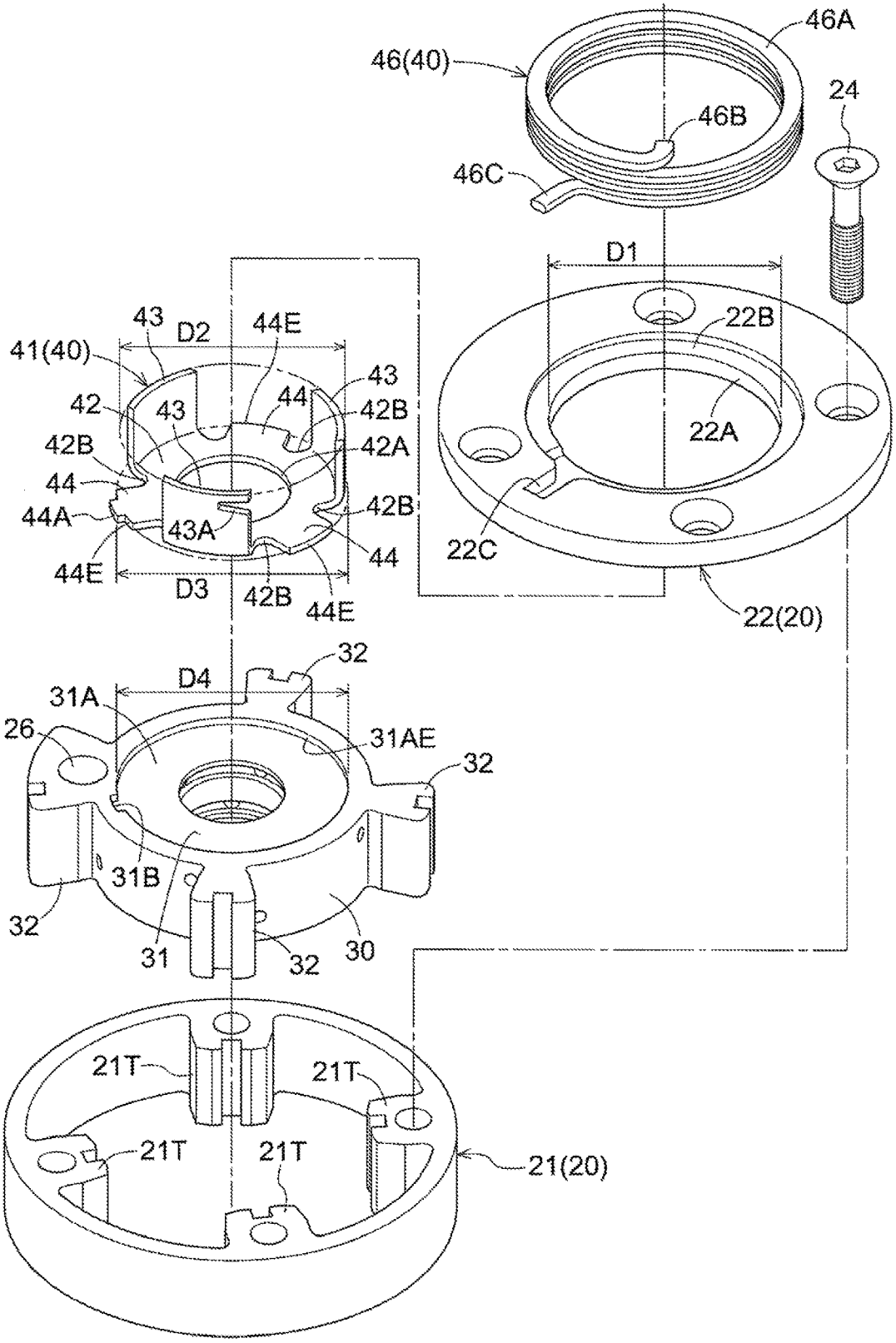
FIG. 5 is an exploded perspective view of the valve opening/closing timing control apparatus.

The valve opening/closing timing control apparatus A, as shown in FIG. 1, FIG. 2 and FIG. 5, includes the outer rotor 20 and the inner rotor 30 and includes also a bush-like adapter 37 at a position sandwiched between the inner rotor 30 and the intake cam shaft 5.

The outer rotor 20 includes an outer rotor main body 21, a front plate 22 as a "lid body" and a rear plate 23, with these members being integrated to each other by fastening of a plurality of fastener bolts 24. In the outer circumference of the rear plate 23, the timing pulley 23P is formed.

At a position sandwiched between the front plate 22 (an example of "lid body") and the rear plate 23, an outer rotor main body 21 is disposed. The outer rotor main body 21 integrally forms a plurality of section portions 21T that protrude inwards in a radial direction relative to the rotational axis X.

The inner rotor 30 includes a cylindrical inner rotor main body 31 that contacts gaplessly protruding ends of the section portions 21T of the outer rotor main body 21, and a plurality of (four) vane portions 32 that protrude from the outer circumference of the inner rotor main body 31 to come into contact with the inner circumferential face of the outer rotor main body 21. Incidentally, the number of the vane portions 32 is not limited to four, but can be set to any desired number.

With the above-described arrangement, at mid positions between adjacent section portions 21T in the rotational direction, a plurality of fluid pressure chambers C are formed on the outer circumferential side of the inner rotor main body 31. And, as these fluid pressure chambers C are partitioned from each other by the vane portions 32, advancing chambers Ca and retarding chambers Cb are formed.

Further, a connecting bolt 38 forms a bolt head portion 38H and a male thread portion 38S. As the male thread portion 38S is threaded to a female thread portion of the intake cam shaft 5, the inner rotor 30 is connected to the intake cam shaft 5. In particular, at the time of this connection, between the bolt head portion 38H and the intake cam shaft 5, the adapter 37, the inner rotor 30 and a plate 42 (an example of a "seat portion") of a spring holder 41 will be clamped, thus being integrated to each other.

The connecting bolt 38 is formed cylindrical centering about the rotational axis X and in an inner hollow portion thereof, there are accommodated a spool 51 of the electromagnetic control valve 50 and a spool spring for urging this in a protruding direction. The arrangement of this electromagnetic control valve 50 will be described later.

This valve opening/closing timing control apparatus A includes, as a phase control mechanism, a lock mechanism L for locking (fixing) the relative rotational phase between the outer rotor 20 and the inner rotor 30 to a most retarded phase. This lock mechanism L includes a locking member 25 that is guided into/out of a guide hole 26 formed in one vane portion 32 under a posture along the rotational axis X, a locking spring that urges the locking member 25 for its protrusion, and a locking recess formed in the rear plate 23. The lock mechanism L is not limited to the one configured to lock to the most retarded phase, but may include e.g. an arrangement of locking to a desired position between the most retarded phase and the most advanced phase.

At the time of an operation of the engine E, a variable torque applied from the intake cam shaft 5 acts in the retarding direction Sb. For this reason, in order to suppress the effect of such variable torque, an urging direction of the urging unit 40 is set to be displaced in the advancing direction Sa relative to the inner rotor 30. The arrangement of this urging unit 40 will be described later herein.

Valve Opening/Closing Timing Control Apparatus: Oil Passage Arrangement

The space for displacing the relative rotational phase in the advancing direction Sa by feeding of work oil is the advancing chamber Ca.

Conversely, the space for displacing the relative rotational phase in the retarding direction Sb by feeding of work oil is the retarding chamber Cb. A relative rotational phase when the vane portion 32 reaches the operational end in the advancing direction Sa (including a phase adjacent the operational end of the vane portion 32 in the advancing direction Sa) will be referred to as the "most advanced phase". A relative rotational phase when the vane portion 32 reaches the operational end in the retarding direction Sb (including a phase adjacent the operational end of the vane portion 32 in the regarding direction Sb) will be referred to as the "most retarded phase".

The inner rotor main body 31 defines retarding flow passages 33 communicated to the retarding chambers Cb and advancing flow passages 34 communicated to the advancing chambers Ca, and the advancing chambers 34 are communicated to the locking recess.

With this valve opening/closing timing control apparatus A in operation, when the lock mechanism L is under a locked state, if the work oil is fed from the advancing flow passage 34 to the locking recess when the work oil is fed into the advancing chamber Ca, the locking member 25 is moved away from the locking recess against the urging force of the locking spring, thus releasing the locked state.

Electromagnetic Control Valve and Oil Passage Arrangement

As shown in FIG. 1, the electromagnetic control valve 50 includes the spool 51, the spool spring and an electromagnetic solenoid 54. More particularly, the spool 51 is disposed to be slidable in the direction along the rotational axis X in the inner space of the connecting bolt 38. The connecting bolt 38 includes a stopper 53 in the form of a stopper ring for fixing an outer end side operational position of the spool 51. Further, the spool spring applies an urging force that moves this spool 51 in the direction away from the intake cam shaft 5 (protrusion direction).

The electromagnetic solenoid 54 includes a plunger 54*a* which operates to protrude by an amount in direct proportion with an amount of electric power fed to the solenoid therein. By a pressing force of this plunger 54*a*, the spool 51 is operated. Further, the spool 51 is rotated in unison with the inner rotor 30 and the electromagnetic solenoid 54 is supported to the engine E, thus becoming inoperable.

The electromagnetic solenoid 54 is disposed at a position that places its plunger 54*a* contactable with an outer end of the spool 51, and is maintained at a non-pressing position under no power supplied state, whereby the spool 51 is maintained at a retarding position. Further, when a predetermined electric power is supplied to the electromagnetic solenoid 54, the plunger 54*a* reaches a pressing position on the inner end side, whereby the spool 51 is maintained at an advancing position. Further, when the electromagnetic solenoid 54 is supplied with electric power which is lower than the power for setting for the advancing position, a protrusion amount of the plunger 54*a* is restricted, whereby the spool 51 is maintained at a neutral position which is midway between the advancing position and the retarding position.

Further, inside the connecting bolt 38, there is formed a flow passage for feeding the work oil to either the retarding flow passage 33 or the advancing flow passage 34 by controlling the work oil from the hydraulic pump P according to a position of the spool 51. Therefore, for example, if the spool 51 is operated to the retarding position by the electromagnetic solenoid 54 and then operated to the neutral position and further operated to the advancing position, in correspondence therewith, there will be provided a state of the work oil from the hydraulic pump P being fed to the retarding chamber Cb, a state of no work oil feeding/discharging and a state of the work oil being fed to the advancing chamber Ca, in this mentioned order.

Valve Opening/Closing Timing Control Apparatus: Urging Unit

The urging unit 40, as shown in FIG. 1 and FIGS. 3-5, consists essentially of the spring holder 41 and a torsion spring 46 supported to the spring holder 41.

In the spring holder 41, the plate 42 connected to the inner rotor main body 31 and a plurality (three in this embodiment) of protruding portions 43 as "guide portion" formed to protrude from the plate 42 along the rotational axis X are formed integrally with each other.

At the center position of the plate 42, there is formed an insertion hole 42A into which the fastener bolt 24 is to be inserted. At a mid position between the protruding portions 43 (an example of "guide portion") that are adjacent each other in the circumferential direction in the outer circumference of the plate 42, a first radial protrusion 44 (an example of an "alignment portion") protruding outward is formed. And, in one of a plurality of (three in this embodiment) such first radial protrusions 44, there is formed a second radial protrusion 44A that protrudes outward from the outer end of the first radial protrusion 44.

The spring holder 41 is to be manufactured by press work of a metal plate, and the plate 42, the plurality of first radial protrusions 44, and the second radial protrusion 44A (an example of "restricted portion") will be disposed on a same virtual plane that assumes a posture perpendicular to the rotational axis X. Further, the plurality of protruding portions 43 respectively are formed with a set width and are formed in an arcuate shape so that outer circumferential faces thereof will be arranged on a circumference centering about the rotational axis X. Further, in order to facilitate bending of the protruding portions 43 in the course of the press work, a border portion between the base end portion of the protruding portion 43 and the base end portion of the first radial protrusion 44 is cut away in the direction of the plate 42, thus forming a cutout portion 42B. This spring holder 41 may be formed by molding of resin also.

At a lateral edge of one of the plurality of protruding portions 43, there is formed a support recess 43A as a support portion in the form of a recess which cuts open a space supporting the first arm 46B of the torsion spring 46. As the plurality of first radial protrusions 44 are fitted within a first engaging recess 31A as an engaging portion of the inner rotor main body 31, outer end edges 44E of the respective first radial protrusions 44 come into contact with a round inner circumferential face 31AE of the first engaging recess 31A (an example of "engaging portion"), thus effecting position fixing. In order to realize this position fixing, a virtual outer circumference circle interconnecting the respective outer end edges 44E is formed arcuate along the circumference of the circle centering about the rotational axis X. As will be described later herein, a diameter of the virtual outer circumference circle is an outer end diameter D3. Incidentally, with this arrangement, the above-described state of the first radial protrusions 44 being fitted in the first engaging recess 31A is an engaged state of such a degree that allows relative rotation therebetween. When the second radial protrusion 44A is fitted into a restricting recess 31B (an example of "restricting portion"), the respective rotation is restricted.

The torsion spring 46 includes a coil portion 46A disposed in a region surrounding the outer circumference of the spring holder 41, a first arm 46B (one end) extending outward from an outer end position of the coil portion 46A in the direction along the rotational axis X and a second arm 46C (the other end) extending radially outward from the outer end position.

As shown in FIG. 5, at the center position of the front plate 22, there is defined a through hole 22A having an inner diameter slightly greater than an outer circumference diameter D2 of the plurality of protruding portions 43 and having also a hole diameter D1 (inner diameter) centered around the rotational axis X. A virtual outer circumferential edge interconnecting outer circumferences of the plurality of protruding portions 43 as viewed in the direction along the rotational axis X constitutes the outer circumference diameter D2. Incidentally, an inner diameter of the coil portion 46A of the torsion spring 46 is set to a value sufficiently greater than the outer circumference diameter D2.

The outer end diameter D3 of the virtual outer circumferential edge interconnecting the outer ends of the plurality of first radial protrusions 44 as viewed in the direction along the rotational axis X is set greater than the hole diameter D1. Further, an inner circumference diameter D4 of the first engaging recess 31A of the inner rotor main body 31 is set to a value slightly greater than the outer end diameter D3. This arrangement allows insertion of the protruding portions 43 having the outer circumference diameter D2 into the through hole 22A having the hole diameter D1. Further, the first radial protrusions 44 having the outer end diameter D3 greater than the hole diameter D1 of the through hole 22A are non-withdrawably held to the front plate 22. Moreover, the arrangement allows fitting of the first radial protrusions 44 having this outer end diameter D3 into the first engaging recess 31A having the inner circumference diameter D4.

In the outer wall of the front plate 22 and at a circumferential region thereof surrounding the through hole 22A, there is formed a spring holding portion 22B in the form of a recess into which a part of the inner end position of the coil portion 46A of the torsion spring 46 is fitted. At a position overlapped with this spring holding portion 22B, there is formed a second engaging recess 22C (an example of "arm holding portion") in the form of a groove extending outward continuously from this spring holding portion 22B.

Figure 4:
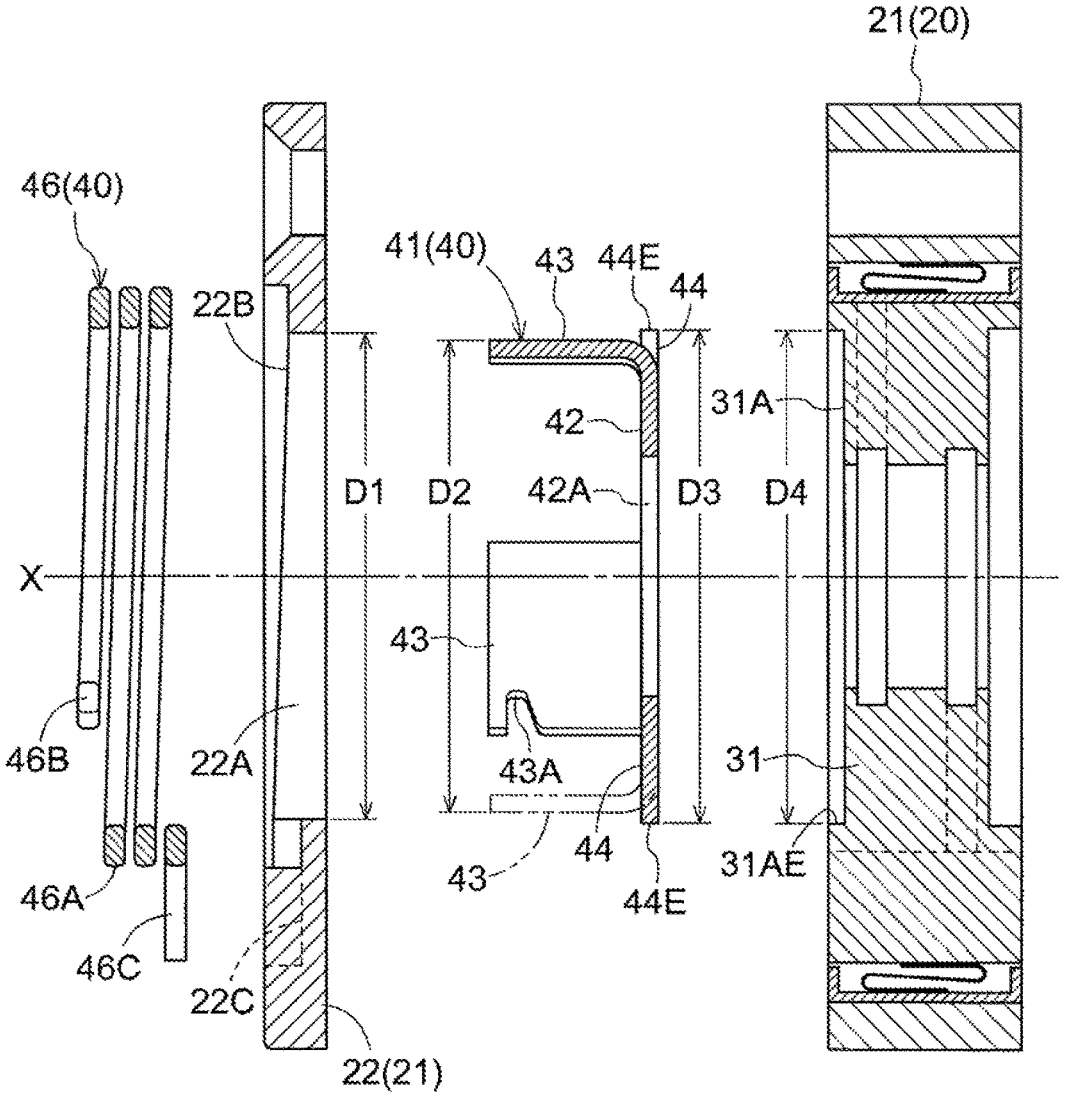
FIG. 4 is a section view showing the urging unit and the front plate under disassembled state thereof.

As shown in FIG. 4, the spring holding portion 22B is formed spiral along the end shape of the coil portion 46A of the torsion spring 46.

Namely, the spring holding portion 22B is formed as a tilted face which is tilted relative to the virtual plane perpendicular to the rotational axis X. As the spring holding portion 22B is formed with a tilt as described above, the depth of the spring holding portion 22B (the value in the direction along the rotational axis X) is not a constant value, but the depth of this spring holding portion 22B is set as a depth that allows accommodation of one turn of the torsion spring 46.

With the above-described arrangement of limiting the depth of the spring holding portion 22B, increase of thickness of the front plate 22 is restricted, thus suppressing enlargement of the valve opening/closing timing control apparatus A. Incidentally, as the torsion spring 46, it is also possible to employ a wire member having a round cross section.

The first engaging recess 31A is formed by causing the area centered around the rotational axis X to be receded relative to the front plate side outer end face of the inner rotor main body 31. This first engaging recess 31A is formed like a circle having the inner circumferential face 31AE centered around the rotational axis X. The inner circumference diameter D4 of this first engaging recess 31A, as described hereinbefore, is set to a value slightly greater than the outer end diameter D3 of the virtual outer circumferential edge interconnecting the outer ends of the plurality of first radial protrusions 44, and at its outer circumferential portion, the restricting recess 31B acting as a restricting portion is formed as a recess.

In this first engaging recess 31A, the plate 42 and the first radial protrusions 44 of the spring holder 41 are fitted and in the restricting recess 31B (an example of "restricting portion"), the second radial protrusion 44A is fitted. And, the depths of the first engaging recess 31A and the restricting recess 31B are set to values that agree with the thickness of the first radial protrusions 44 of the spring holder 41. With this arrangement, when the front plate 22 is connected to the outer rotor main body 21 with the plurality of fastener bolts 24, the first radial protrusions 44 of the spring holder 41 are pressed down by the outer circumference of the through hole 22A of the front plate 22, thus becoming un-withdrawable.

Incidentally, the restricting recess 31B may be formed at a plurality of portions of the first engaging recess 31A. Further, in order to restrict relative rotation between the spring holder 41 and the inner rotor 30, a recess may be formed in the outer circumference of the first radial protrusion 44 and a protrusion engageable therewith may be formed in the inner circumference of the first engaging recess 31A. Since the restricting recess 31B is formed in the radial direction as described above, there occurs no increase in the thickness of the inner rotor 30, in comparison with e.g. an arrangement in the form of a hole along the rotational axis X.

Assembly of Urging Unit

The rear plate 23 is disposed at the rear portion of the outer rotor main body 21 and the inner rotor main body 31 is fitted in its inside and the spool 51 etc. are accommodated inside the connecting bolt 38.

Next, the protruding portions 43 of the spring holder 41 are inserted into the through hole 22A of the front plate 22 from the rear face side thereof and the torsion spring 46 is disposed to surround the plurality of protruding portions 43.

When the torsion spring 46 is to be disposed in the manner described above, a portion of the coil portion 46A is fitted into the spring holding portion 22B of the front plate 22 and the second arm 46C of the torsion spring 46 is fitted into the second engaging recess 22C. Further, the first arm 46B of the torsion spring 46 is engaged to the support recess 43A (an example of "support portion") of the protruding portion 43 to be held therein.

Next, the first radial protrusions 44 of the spring holder 41 are fitted into the first engaging recess 31A of the inner rotor main body 31 and the second radial protrusion 44A is fitted into the restricting recess 31B. With this, the outer end edges 44E of the plurality of first radial protrusions 44 come into contact with the cylindrical inner circumferential face 31AE of the first engaging recess 31A and fixed in position in such a manner as to hold the gravity center position of the spring holder 41 at the position of the rotational axis X. Whereby, there is realized a state in which the inner rotor main body 31 and the spring holder 41 are rotatable in unison with each other.

Next, the front plate 22 is placed over the outer rotor main body 21 and these are connected to each other by the fastener bolts 24. Further, the connecting bolt 38 is inserted into the through hole 42A of the plate 42 of the spring holder 41 and the male thread portion 38S of this connecting bolt 38 is threaded to the female thread portion of the intake cam shaft 5, thus completing the fastening.

With the above, the intake cam shaft 5, the inner rotor 30 and the spring holder 41 are integrated to each other, thus completing the valve opening/closing timing control apparatus A. Under this completed state, as the first radial protrusions 44 of the spring holder 41 are pressed down by the outer circumference of the through hole 22A of the front plate 22, floating-up of the spring holder 41 is prevented.

Under this completed state, the torsion spring 46 of the urging unit 40 provides an urging force to displace the inner rotor 30 in the advancing direction Sa relative to the outer rotor 20. Also, as a portion of the coil portion 46A of the torsion spring 46 which portion is adjacent the front plate 22 is fitted into the spring holding portion 22B under the tilted posture, the torsion spring 46 can be supported with the axis of the coil portion 46A of this torsion spring 46 being in agreement with the rotational axis X. Moreover, since the inner circumference of the coil portion 46A of the torsion spring 46 is disposed at the position away from the outer circumferences of the protruding portions 43, at the time of change of relative rotational phase, no resistance is applied therebetween, so no frictional wear of the outer circumferences of the protruding portions 43 will occur, either.

Function and Effect of Embodiment

Since the urging unit 40 is provided externally of the main body portion (phase control mechanism) constituted of the outer rotor 20 and the inner rotor 30, compactization of the main body portion is made possible.

In case the spring holder 41 is attached to the inner rotor main body 31 as provided in this embodiment, by fitting the first radial protrusions 44 into the first engaging recess 31A of the inner rotor main body 31 for position fixing, the gravity center position of the spring holder 41 can be positioned coaxial with the rotational axis X. Moreover, only with fitting-in of the second radial protrusion 44A of the spring holder 41, the spring holder 41 and the inner rotor 30 can be made rotatable in union with each other.

In comparison with an arrangement of fixing the spring holder 41 to the inner rotor 30 by press-fitting, no deformation occurs in the inner rotor 30 and no increase of sliding resistance in association with deformation of such press-fitting operation occurs, either. Furthermore, for instance, in the case of an arrangement wherein one end of the torsion spring 46 is directly engaged to the outer rotor 20 or the inner rotor 30, such arrangement requires enhancement of strength of the engagement portion. In contrast, by using the spring holder 41, there is no need to increase the strength of either of the rotors and no frictional wear occurs at the portion engaged with the spring, either.

In this embodiment, the inner end side of the coil portion 46A of the torsion spring 46 in the direction of the rotational axis X is supported as being fitted into the tilted spring holding portion 22B of the front plate 22. With this, the axial position of the coil portion 46A of the torsion spring 46 is in agreement with the rotational axis X and no vibration occurs in the torsion spring 46 during rotation. Further, since the portion of the coil portion 46A of the coil spring 46 comes into contact with the titled face of the spring holding portion 22B over a large area, reduction of frictional wear due to locally concentrated contact is realized also.

Since the hole diameter D1 of the through hole 22A of the front plate 22 is made smaller than the outer end diameter D3 of the plurality of first radial protrusions 44, the front plate 22 presses down the spring holder 41, thus preventing float-up of the spring holder 41.

With the valve opening/closing timing control apparatus A having the above-described configuration, leak of work oil occurs between the outer rotor 20 and the inner rotor 30. And, by causing such leaked work oil to be discharged to the outside via the through hole 22A of the front plate 22, the work oil is fed between the torsion spring 46 and the spring holding portion 22B, whereby frictional wear of the spring holding portion 22B can be suppressed.

Other Embodiments

In addition to the above-described embodiment, the invention may be embodied as described next.

Figure 6:
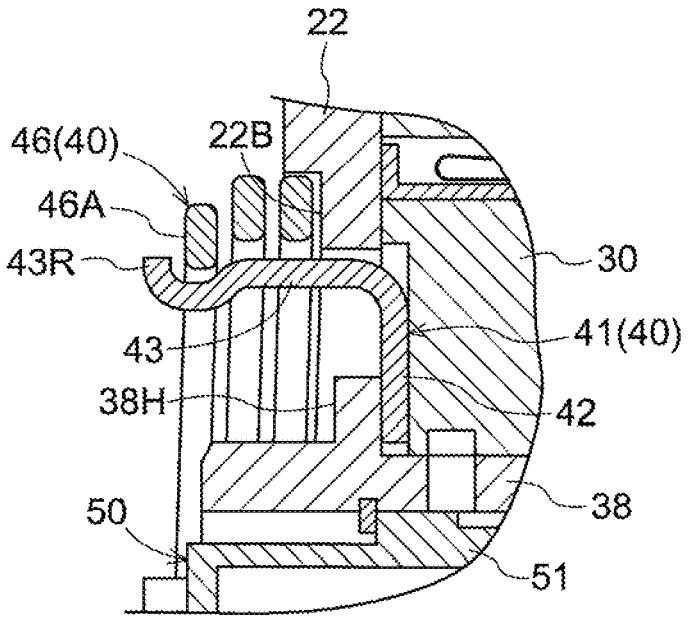
FIG. 6 is a section view showing a detachment preventing portion in a further embodiment (a)

(a) As shown in FIG. 6, the protrusion ends of the plurality of protruding portions 43 may have a reduced diameter, so that a region continuous on the protrusion end side overhangs outwards, thus forming a detachment preventing protrusion 43R in the form of an extension portion. In this arrangement, the coil diameter of the outer side of the torsion spring 46 is reduced to be overlapped with the detachment preventing protrusion 43R (extension portion). With this, even when the torsion spring 46 is moved in the direction of protrusion end of the protruding portion 43, the reduced-diameter portion of the torsion spring 46 comes into contact with the detachment preventing protrusion 43R, thus preventing detachment. Incidentally, as this further embodiment (a), the detachment preventing protrusion 43R may be provided at the protrusion end of a cylindrically shaped protruding portion 43 (i.e. the protruding portions 43 are provided as a single protruding portion). Further, as the torsion spring 46, a torsion spring whose all turns have a same coiling diameter may be employed.

Figure 7:
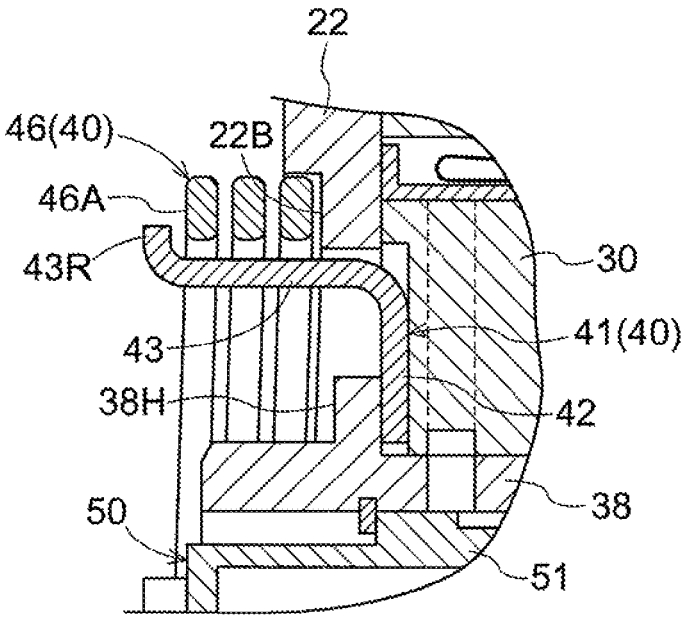
FIG. 7 is a section view showing a detachment preventing portion in a further embodiment (b)

(b) As shown in FIG. 7, the protrusion ends of the plurality of protruding portions 43 have an increased diameter, whereby a detachment preventing protrusion 43R in the form of an outwardly extending extension portion is formed. In this arrangement, even when the torsion spring 46 is moved in the direction of protrusion end of the protruding portion 43, the torsion spring 46 comes into contact with the detachment preventing protrusion 43R, thus preventing detachment. Incidentally, as this further embodiment (b), the detachment preventing protrusion 43R may be provided at the protrusion end of a cylindrically shaped protruding portion 43 (i.e. the protruding portions 43 are provided as a single protruding portion).

Figure 8:
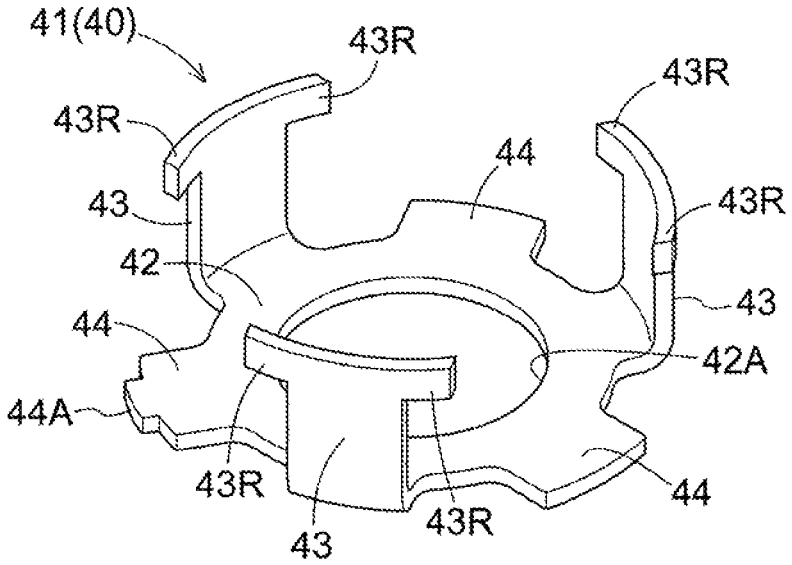
FIG. 8 is a section view showing a detachment preventing portion in a further embodiment (c)

(c) As shown in FIG. 8, the protruding end portions of the plurality of protruding portions 43 are extended in the circumferential direction, whereby a detachment preventing protrusion 43R is formed in the form of an extension portion that extends from the protrusion ends of the protruding portions 43 in the circumferential direction. With this detachment preventing protrusion 43R, even when the torsion spring 46 is moved in the direction of protrusion end of the protruding portion 43, the torsion spring 46 comes into contact with the detachment preventing protrusion 43R, thus preventing detachment.

Figure 9:
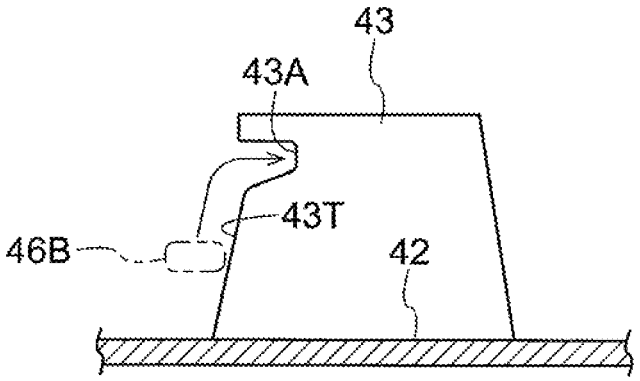
FIG. 9 is a section view showing a first engaging portion in a further embodiment (d).

(d) As shown in FIG. 9, of the plurality of protruding portions 43, the end edge where the support recess 43A is formed is formed in a tilted portion 43T. In the tilting direction of this tilted portion 43T, when the first arm 46B of the torsion spring 46 comes into contact with a position closer to the plate 42 than this first support recess 43A, this first arm 46B can be guided in the direction (protruding direction of the protruding portions 43) of the support recess 43A, thus providing reliable engagement.

Incidentally, the tilted portion 43T of this further embodiment (d) may be provided in all of the plurality of protruding portions 43. With this arrangement, if the first arm 46B of the torsion spring 46 comes into contact with a protruding portion 43 having no support recess 43A therein, detachment will occur readily, so that erroneous attachment can be suppressed. Moreover, by making the shapes of the plurality of protruding portions 43 same, it becomes also possible to improve rotation balance of the spring holder 41.

(e) For instance, it is possible to arrange an engaging portion such that there is formed a ring-shaped protruding engaging portion that protrudes in the direction of the rotational axis X from the opening edge of the hole portion for insertion of the connecting bolt 38 in the inner rotor main body 31 and to this protruding engaging portion, the insertion hole 42A of the plate 42 of the spring holder 41 is fitted externally. With this arrangement, the spring holder 41 can be engaged and held in the inner rotor main body 31. Further, in the arrangement of this further embodiment (e), the insertion hole 42A acts also as the alignment portion. For instance, a recess as a restricting portion may be formed in the outer circumference of the protruding engaging portion and an engaged portion to be engaged therewith may be formed in the inner circumference of the insertion hole 42A of the plate 42.

With this arrangement too, it is possible to hold the spring holder 41 at a position fixed relative to the inner rotor 30 and to make the inner rotor 30 rotatable in unison.

INDUSTRIAL APPLICABILITY

The present invention can be utilized in a valve opening/closing timing control apparatus having a mechanism for urging a relative rotational phase between a driving side rotary body and a driven side rotary body in a predetermined direction.

REFERENCE SIGNS LIST

1: crank shaft
5: cam shaft (intake cam shaft)
20: driving side rotary body (outer rotor)
22: lid member (front plate)
22A: through hole
30: driven side rotary body (inner rotor)
31: engaging portion (engaging recess)
31AE: inner circumferential face
31B: restricting portion (restricting recess)
41: spring holder
42: seat portion
42B: cut-in portion
43: guide portion (protruding portion)
43T: tilted portion
43A: support portion (first engaging portion)
43R: extension portion (detachment preventing portion)
44: alignment portion
44A: restricted portion (rotation restricting portion)
46: torsion spring
46B: one end (first arm)
A: valve opening/closing timing control apparatus
E: internal combustion engine (engine)
D1: inner diameter (hole diameter)
D2: outer circumferential diameter
D3: outer end diameter
X: rotational axis

The invention claimed is:

1. A valve opening/closing timing control apparatus comprising:

a driving side rotary body rotatable in synchronism with a crank shaft of an internal combustion engine;

a driven side rotary body rotatable in unison and coaxially with a valve opening/closing cam shaft; and a spring holder supporting a torsion spring that is connected between the driving side rotary body and the driven side rotary body;

wherein the spring holder includes a seat portion that is fixed to an engaging portion provided in the driven side rotary body by being fitted therein, and a guide portion that protrudes from the seat portion along a rotational axis of the cam shaft;

wherein the seat portion defines an alignment portion engageable with the engaging portion effecting alignment and a restricted portion engageable with a restricting portion formed in the engaging portion in a radial direction perpendicular to the rotational axis, thereby to restrict rotation of the seat portion;

wherein the guide portion defines a support portion supporting an end of the torsion spring;

wherein, in the spring holder, the seat portion, a plurality of the guide portions and a plurality of the alignment portions are formed integral by a work on a plate-like material;

wherein the guide portions and the alignment portions are disposed in alternation in a circumferential direction in an outer circumference of the seat portion; and wherein, at a mid position therebetween, a portion of the seat portion is cut away in the direction of the rotational axis to form a cut-in portion.

2. The valve opening/closing timing control apparatus according to claim 1, wherein the support portion is formed by cutting away a portion of the guide portions into a form of a recess which cuts open a space supporting the end of the torsion spring.

3. The valve opening/closing timing control apparatus according to claim 2, wherein:

relative to the seat portion, the plurality of guide portions are formed integral to extend along the rotational axis; and in an end face of the plurality of guide portions where the support portion is formed, there is formed a tilted portion that guides the end of the torsion spring to the support portion.

4. The valve opening/closing timing control apparatus according to claim 1, wherein:

the driving side rotary body includes a lid body defining a through hole at the center thereof;

an outer circumferential diameter interconnecting outer circumferences of the plurality of guide portions centering about the rotational axis is set smaller than an inner diameter of the through hole; and an outer end diameter interconnecting outer ends of the alignment portions centering about the rotational axis is set greater than the inner diameter of the through hole.

5. The valve opening/closing timing control apparatus according to claim 1, wherein:

the torsion spring is disposed in an outer circumference of a plurality of guide portions; and the guide portion includes, at its end, an extension portion extending in the radial direction.

6. A valve opening/closing timing control apparatus comprising:

a driving side rotary body rotatable in synchronism with a crank shaft of an internal combustion engine;

a driven side rotary body rotatable in unison and coaxially with a valve opening/closing cam shaft; and a spring holder supporting a torsion spring that is connected between the driving side rotary body and the driven side rotary body;

wherein the spring holder includes a seat portion that is fixed to an engaging portion provided in the driven side rotary body by being fitted therein, an alignment portion that protrudes outward from the seat portion under a posture perpendicular to the rotational axis, and a guide portion that protrudes from the seat portion along the rotational axis;

wherein the driving side rotary body includes a lid body that defines a through hole at a center thereof;

wherein an outer circumferential diameter of an outer circumference interconnecting a plurality of the guide portions centering about the rotational axis is set smaller than an inner diameter of the through hole; and wherein an outer end diameter interconnecting an outer end of the alignment portion centering about the rotational axis is set greater than the inner diameter of the through hole.

* * * * *